US008633148B2

(12) United States Patent
Smets et al.

(10) Patent No.: US 8,633,148 B2
(45) Date of Patent: Jan. 21, 2014

(54) ENCAPSULATES

(75) Inventors: Johan Smets, Lubbeek (BE); Susana Fernandez Prieto, Benicarlo-Castellon (ES); Sandra Jacqueline Guinebretiere, Appleton, WI (US)

(73) Assignee: The procter & Gamble Company, Cincinnati, OH (US)

( * ) Notice: Subject to any disclaimer, the term of this patent is extended or adjusted under 35 U.S.C. 154(b) by 112 days.

(21) Appl. No.: 13/079,877

(22) Filed: Apr. 5, 2011

(65) Prior Publication Data

US 2011/0245134 A1 Oct. 6, 2011

Related U.S. Application Data

(60) Provisional application No. 61/321,320, filed on Apr. 6, 2010, provisional application No. 61/348,346, filed on May 26, 2010, provisional application No. 61/367,972, filed on Jul. 27, 2010.

(51) Int. Cl.

| | |
|---|---|
| ***C11D 17/08*** | (2006.01) |
| ***C11D 7/38*** | (2006.01) |
| ***C11D 7/42*** | (2006.01) |
| ***C11D 7/54*** | (2006.01) |

(52) U.S. Cl.

USPC ..... 510/441; 510/302; 510/309; 510/311; 510/312; 510/313; 510/320; 510/349; 510/376; 510/378; 510/392; 510/475; 510/499; 510/500; 510/505

(58) Field of Classification Search

USPC ..... 510/302, 309, 311, 312, 313, 320, 349, 510/375, 376, 378, 392, 441, 475, 499, 500, 510/505

See application file for complete search history.

(56) References Cited

U.S. PATENT DOCUMENTS

| | | | | |
|---|---|---|---|---|
| 3,299,112 | A | 1/1967 | Bailey | |
| 4,430,243 | A | 2/1984 | Bragg | |
| 4,818,421 | A | 4/1989 | Boris et al. | |
| 4,911,852 | A | 3/1990 | Coffindaffer et al. | |
| 5,576,282 | A | 11/1996 | Miracle et al. | |
| 5,595,967 | A | 1/1997 | Miracle et al. | |
| 5,597,936 | A | 1/1997 | Perkins et al. | |
| 5,807,956 | A | 9/1998 | Czech | |
| 5,981,681 | A | 11/1999 | Czech | |
| 6,225,464 | B1 | 5/2001 | Hiler, II et al. | |
| 6,306,812 | B1 | 10/2001 | Perkins et al. | |
| 6,326,348 | B1 | 12/2001 | Vinson et al. | |
| 6,420,333 | B1 | 7/2002 | Hsu et al. | |
| 6,903,061 | B2 | 6/2005 | Masschelein et al. | |
| 6,951,836 | B2 * | 10/2005 | Jahns et al. | 510/441 |
| 7,273,837 | B2 | 9/2007 | Boutique et al. | |
| 7,335,630 | B2 | 2/2008 | Delplancke et al. | |
| 2003/0125222 | A1 | 7/2003 | Boeckh et al. | |
| 2005/0098759 | A1 | 5/2005 | Frankenbach et al. | |
| 2005/0112152 | A1 | 5/2005 | Popplewell et al. | |
| 2005/0170994 | A1 | 8/2005 | Casado-Dominguez et al. | |
| 2007/0275866 | A1 | 11/2007 | Dykstra | |
| 2009/0275494 | A1 | 11/2009 | Ferguson et al. | |

FOREIGN PATENT DOCUMENTS

| | | | | |
|---|---|---|---|---|
| DE | 10 2005 036 346 | A1 | | 1/2009 |
| EP | 0 484 081 | A2 | | 5/1992 |
| GB | 1549180 | | * | 7/1979 |
| WO | WO 93/01269 | A1 | | 1/1993 |
| WO | WO 2006/063483 | A1 | | 6/2006 |
| WO | WO2007/062833 | | * | 7/2007 |
| WO | WO 2008/005693 | A2 | | 1/2008 |
| WO | WO 2011/020652 | A1 | | 2/2011 |

OTHER PUBLICATIONS

International Search Report for U.S. Appl. No. 13/079,877 mailed Aug. 16, 2011, 4 pages.

International Search Report for U.S. Appl. No. 13/079,880 mailed Aug. 3, 2011, 3 pages.

Hansch, et al.—Comprehensive Medicinal Chemistry, vol. 4, p. 295, Pergamon Press, 1990.

Zhang, Z., et al.—Journal of Microencapsulation, vol. 18, No. 5, pp. 593-602, 2001.

U.S. Appl. No. 13/079,880, filed Apr. 5, 2011, Smets et al.

* cited by examiner

*Primary Examiner* — Gregory Delcotto

(74) *Attorney, Agent, or Firm* — Melissa G. Krasovec; Steven W. Miller

(57) ABSTRACT

The present application relates to encapsulated, solid, water soluble benefit agents and products comprising such encapsulates, as well as processes for making and using such encapsulates and products comprising such encapsulates. In one aspect, the present application relates to a melamine formaldehyde and/or urea formaldehyde encapsulation process that offers as solution to the dissolution of solid, water soluble benefit agents during the process's emulsification step.

20 Claims, No Drawings

ENCAPSULATES

CROSS-REFERENCES TO RELATED APPLICATIONS

This application claims priority under 35 U.S.C. §119(e) to U.S. Provisional Application Ser. No. 61/321,320 filed Apr. 6, 2010, U.S. Provisional Application Ser. No. 61/348,436 filed May 26, 2010, and U.S. Provisional Application Ser. No. 61/367,972 filed Jul. 27, 2010.

FIELD OF INVENTION

The present application relates to encapsulated, solid, water soluble benefit agents and products comprising such encapsulates, as well as processes for making and using such encapsulates and products comprising such encapsulates.

BACKGROUND OF THE INVENTION

Products (e.g., consumer products) may comprise one or more solid, water soluble benefit agent that can provide a desired benefit to such product and/or a situs that is contacted with such a product (e.g., stain removal and/or bleaching). Unfortunately, such benefit agents may degrade, or be degraded by, other components of a product before such product is used. Thus, a protection system that protects the components of a product is desired. Protection systems include coating processes such as starch encapsulation and agglomeration. While such processes offer certain benefits, new protection processes that allow for triggered benefit agent release are desired. While melamine formaldehyde and/or urea formaldehyde encapsulating technologies exist, Applicants recognized that such technologies do not allow the effective encapsulation of solid, water soluble benefit agents because such solid, water soluble benefit agents dissolve during the emulsification step of the encapsulation process and may interact with the melamine, urea or formaldehyde during the polymerization step of the process. In short, Applicants recognized the source of the problem and in the present specification disclose a solution to such problem, as well as an effective encapsulation process that employs such solution. In addition, Applicants recognized the importance of having, among other things, the correct encapsulate fracture strength. Thus, encapsulates made by the aforementioned process, as well as products comprising such encapsulates, are disclosed. Surprisingly, such encapsulates are stable in consumer products, yet release the majority of their solid, water soluble benefit agent(s) when the consumer product is used as intended.

SUMMARY OF THE INVENTION

The present application relates to encapsulated, solid, water soluble benefit agents and products comprising such encapsulates, as well as processes for making and using such encapsulates and products comprising such encapsulates. In one aspect, the present application relates to a melamine formaldehyde and/or urea formaldehyde encapsulation process that offers a solution to the dissolution of solid, water soluble benefit agents during the process's emulsification step.

DETAILED DESCRIPTION OF THE INVENTION

Definitions

As used herein "consumer product" means baby care, beauty care, fabric & home care, family care, feminine care, health care, or devices generally intended to be used in the form in which it is sold. Such products include but are not limited to diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use including fine fragrances; and shaving products, products for and/or methods relating to treating fabrics, hard surfaces and any other surfaces in the area of fabric and home care, including: air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; over-the-counter health care including cough and cold remedies, pain relievers, RX pharmaceuticals.

As used herein, the term "cleaning and/or treatment composition" is a subset of consumer products that includes, unless otherwise indicated, beauty care, fabric & home care products. Such products include, but are not limited to, products for treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use including fine fragrances; and shaving products, products for treating fabrics, hard surfaces and any other surfaces in the area of fabric and home care, including: air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners including toilet bowl cleaners; hair shampoos and hair-rinses; shower gels, fine fragrances and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists all for consumer or/and institutional use; and/or methods relating to oral care including toothpastes, tooth gels, tooth rinses, denture adhesives, tooth whitening.

As used herein, the term "fabric and/or hard surface cleaning and/or treatment composition" is a subset of cleaning and treatment compositions that includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents;

hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, car or carpet shampoos, bathroom cleaners including toilet bowl cleaners; and metal cleaners, fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists. All of such products which are applicable may be in standard, concentrated or even highly concentrated form even to the extent that such products may in certain aspect be non-aqueous.

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel, paste and gas product forms.

As used herein, the term "situs" includes paper products, fabrics, garments, hard surfaces, hair and skin.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Consumer Products

In one aspect a consumer product comprising particles, said particles comprising a shell material and a core material, said shell material encapsulating said core material, said shell material comprising a material selected from cross-linked melamine formaldehyde, cross-linked urea formaldehyde and mixtures thereof; said core material comprising, a protective suspension agent, a solid, water soluble benefit agent and an optional hydrophobic organic material, at least 75%, 85% or even 90% of said particles having a fracture strength of from about 0.1 MPa to about 5 MPa, from about 0.2 MPa to about 3 MPa, from about 0.2 MPa to about 2.0 MPa, or even from about 0.2 MPa to about 1.2 MPa; and a consumer product adjunct ingredient is disclosed.

In one aspect of said consumer product, said water soluble benefit agent may have a water solubility of at least 10 g/liter, from about 1 mg/liter to about 800 g/liter, from about 1 g/liter to about 600 g/liter, from about 100 g/liter to about 500 g/liter or even from about 150 g/liter to about 400 g/liter.

In one aspect of said consumer product, said solid, water soluble benefit agent may be micronized at a particle size below the particle size of the capsule. In one embodiment, 50%, 75%, 90% or even 99% of said micronized solid, water soluble benefit agent has a particle size below 80 microns, below 50 microns, below 20 microns, below 8 microns or even below 5 microns. In one embodiment, the solid, water soluble benefit agent, is micronized by a grinding process.

In one aspect of said consumer product, said consumer product may comprise, based total consumer product weight, from about 0.01% to about 80%, from about 0.1% to about 50%, from about 1% to about 25% or from about 1% to about 10% of said particle.

In one aspect of said consumer product, said particle may have a benefit agent release of at least 10%, at least 25%, at least 35%, from 50% to about 100%, from 65% to about 95%, or even from 85% to about 95% of said benefit agent after 10 minutes, 8 minutes or even 5 minutes of use of such consumer product containing said particles.

In one aspect of said consumer product, at least 75%, 85% or even 90% of said particles may have a particle wall thickness of from about 30 nm to about 250 nm, from about 40 nm to about 180 nm, or even from about 50 nm to about 150 nm.

In one aspect of said consumer product, at least 75%, 85% or even 90% of said particles may have a particle size of from about 1 micron to about 100 microns, about 5 microns to 80 microns, from about 6 microns to about 50 microns, or even from about 15 microns to about 40 microns.

In one aspect of said consumer product, said consumer product's particle may comprise, based total particle weight, from about 1% to about 95%, from about 1% to about 95%, from about 5% to about 80% or from about 5% to about 50% core material.

In one aspect, the core material of said consumer product's particle may comprise, based total core weight, from about 0.01% to about 80%, from about 0.1% to about 50%, from about 1% to about 25% or from about 1% to about 10% of said solid, water soluble benefit agent.

In one aspect of said consumer product, said solid, water soluble benefit agent may comprise a material selected from the group consisting of a metal catalyst, a non-metal catalyst, an activator, a pre-formed peroxy carboxylic acid, a diacyl peroxide, a hydrogen peroxide source, an enzyme and mixtures thereof.

In one aspect of said consumer product, a) said metal catalyst may comprise a material selected from the group consisting of dichloro-1,4-diethyl-1,4,8,11-tetraaazabicyclo[6.6.2]hexadecane manganese(II); dichloro-1,4-dimethyl-1,4,8,11-tetraaazabicyclo[6.6.2]hexadecane manganese(II) and mixtures thereof;

b) said non-metal catalyst may comprise material selected from the group consisting of 2-[3-[(2-hexyldodecyl)oxy]-2-(sulfooxy)propyl]-3,4-dihydroisoquinolinium, inner salt; 3,4-dihydro-2-[3-[(2-pentylundecyl)oxy]-2-(sulfooxy)propyl]isoquinolinium, inner salt; 2-[3-[(2-butyldecyl)oxy]-2-(sulfooxy)propyl]-3,4-dihydroisoquinolinium, inner salt; 3,4-dihydro-2-[3-(octadecyloxy)-2-(sulfooxy)propyl]isoquinolinium, inner salt; 2-[3-(hexadecyloxy)-2-(sulfooxy)propyl]-3,4-dihydroisoquinolinium, inner salt; 3,4-dihydro-2-[2-(sulfooxy)-3-(tetradecyloxy)propyl]isoquinolinium, inner salt; 2-[3-(dodecyloxy)-2-(sulfooxy)propyl]-3,4-dihydroisoquinolinium, inner salt; 2-[3-[(3-hexyldecyl)oxy]-2-(sulfooxy)propyl]-3,4-dihydroisoquinolinium, inner salt; 3,4-dihydro-2-[3-[(2-pentylnonyl)oxy]-2-(sulfooxy)propyl]isoquinolinium, inner salt; 3,4-dihy dro-2-[3-[(2-propylheptyl)oxy]-2-(sulfooxy)propyl] isoquinolinium, inner salt; 2-[3-[(2-butyloctyl)oxy]-2-(sulfooxy)propyl]-3,4-dihydroisoquinolinium, inner salt; 2-[3-(decyloxy)-2-(sulfooxy)propyl]-3,4-dihydroisoquinolinium, inner salt; 3,4-dihydro-2-[3-(octyloxy)-2-(sulfooxy)propyl]isoquinolinium, inner salt; 2-[3-[(2-ethylhexyl)oxy]-2-(sulfooxy)propyl]-3,4-dihydroisoquinolinium, inner salt and mixtures thereof;

c) said activator may comprise a material selected from the group consisting of tetraacetyl ethylene diamine (TAED); benzoylcaprolactam (BzCL); 4-nitrobenzoylcaprolactam; 3-chlorobenzoy¬caprolactam; benzoyloxybenzenesulphonate (BOBS); nonanoyloxybenzene¬isulphonate (NOBS); phenyl benzoate (PhBz); decanoyloxybenzenesulphonate (C10-OBS); benzoylvalerolactam (BZVL); octanoyloxybenzenesulphonate (C8-OBS); perhydrolyzable esters; 4-[N-(nonaoyl) amino hexanoyloxy]-benzene sulfonate sodium salt (NACA-OBS); dodecanoyloxybenzenesulphonate (LOBS or C12-OBS); 10-undecenoyloxybenzenesulfonate (UDOBS or C11-OBS with unsaturation in the 10 position); decanoyloxybenzoic acid (DOBA); (6-octanamidocaproyl)oxybenzenesulfonate; (6-nonanamidocaproyl) oxybenzenesulfonate; (6-decanamidocaproyl)oxybenzenesulfonate and mixtures thereof;

d) said preformed peracid may comprise a material selected from the group consisting of peroxymonosulfuric acids; perimidic acids; percabonic acids; percarboxilic acids and salts of said acids; in one aspect said percarboxilic acids and salts thereof may be phthalimidoperoxyhexanoic acid, 1,12-diperoxydodecanedioic acid; or monoperoxyphthalic acid (magnesium salt hexahydrate); amidoperoxyacids, in one aspect, said amidoperoxyacids may be N,N'-terephthaloyl-di(6-aminocaproic acid), a monononylamide of either peroxysuccinic acid (NAPSA) or of peroxyadipic acid (NAPAA), N-nonanoylaminoperoxycaproic acid (NAPCA)—and mixtures thereof; in one aspect, said preformed peracid comprises phthalimidoperoxyhexanoic acid;

e) said diacyl peroxide may comprise a material selected from the group consisting of dinonanoyl peroxide, didecanoyl peroxide, diundecanoyl peroxide, dilauroyl peroxide, dibenzoyl peroxide, di-(3,5,5-trimethyl hexanoyl) peroxide and mixtures thereof; in one aspect, said diacyl peroxide is, clatharated;

f) said hydrogen peroxide source may comprise a material selected from the group consisting of a perborate, a percarbonate a peroxyhydrate, a peroxide, a persulfate and mixtures thereof, in one aspect said hydrogen peroxide source comprises sodium perborate, in one aspect said sodium perborate comprises a mono- or tetra-hydrate, sodium pyrophosphate peroxyhydrate, urea peroxyhydrate, trisodium phosphate peroxyhydrate or sodium peroxide and mixtures thereof; and g) said enzyme may comprise a material selected from the group consisting of peroxidases, proteases, lipases, phospholipases, cellobiohydrolases, cellobiose dehydrogenases, esterases, cutinases, pectinases, mannanases, pectate lyases, keratinases, reductases, oxidases, phenoloxidases, lipoxygenases, ligninases, pullulanases, tannases, pentosanases, glucanases, arabinosidases, hyaluronidase, chondroitinase, laccases, amylases, and mixtures thereof.

In one aspect, the core material of said consumer product's particle may comprise, based total core weight, from about 0.1% to about 99%, from about 1% to about 95%, from about 1% to about 80% or from about 5% to about 50% of said protective suspension agent.

In one aspect of said consumer product, said protective suspension agent comprises an organosilicone said organosilicone being linear, branched and/or crosslinked and having a viscosity at 25° C. of from about 500 centistokes to about 2,000,000 centistokes, from about 1000 centistokes to about 800,000 centistokes or even from about 1000 centistokes to about 300,000 centistokes.

In one aspect, the protective suspension agent may comprise:

| centiStokes (cSt) | Typical liquid |
|---|---|
| 1000 | Silicone DC 200 ® Fluid* |
| 12,500 | Silicone DC 200 ® Fluid* |
| 60,000 | Silicone, polysiloxane, Dow Corning DC 200 ® |

*silicone DC200 ® Fluid is available in a range of viscosities under the tradename DC200 ® Fluid. Other silicones that are useful as hydrophobic organic materials and that are available from Dow Corning, Midland, MI, include silicone DC 245 ® Fluid and silicone DC 246 ® Fluid In one aspect, the protective suspension agent may have a viscosity of at least 500 centistokes. For purposes of the invention, the protective suspension agent could be blended with differing viscosity materials such as silicone 60,000 centistokes (cSt) and silicone 100 cSt to achieve a resultant viscosity of at least 500 centistokes. Such blends with resultant viscosities of at least 500 cSt are intended as encompassed by the phrase "the protective agent has a viscosity of at least 500 cSt".

of said consumer product, said organosilicone may comprise a material selected from the group consisting of non-functionalized siloxane polymers, functionalized siloxane polymers and mixtures thereof In one aspect of said consumer product, said functionalized siloxane polymers may comprise an aminosilicone.

In one aspect, the core material of said consumer product's particle may comprise, based total core weight, from about 0.1% to about 99%, from about 1% to about 95%, from about 1% to about 80% or from about 5% to about 80% of said hydrophobic organic material.

In one aspect of said consumer product, said hydrophobic organic material may comprise a material having a ClogP from about 1.5 to about 10, from about 1.5 to about 6, from about 2 to about 5 or even from about 2.2 to about 4.5.

In one aspect of said consumer product, said hydrophobic organic material may comprise a material selected from the group consisting of an aliphatic hydrophobic organic material; an aromatic hydrophobic organic material and mixtures thereof.

In one aspect of said consumer product, said hydrophobic organic material may comprise a material selected from the group consisting of a carboxylic acid, an ester, an alcohol, a fatty acid, a natural oil, a synthetic oil, an aldehyde, a ketone, a nitrile, a hydrocarbon, an ether, an acetal, a Schiff Base, a wax and mixtures thereof.

In one aspect of said consumer product;

a) said alcohol may comprise a material selected from the group Table 1;

b) said ester may comprise a material selected from the group Table 2;

c) said ether may comprise a material selected from the group Table 3;

d) said carboxylic acid may comprise a material selected from the group Table 4;
e) said nitrile may comprise a material selected from the group Table 5;
f) said amine may comprise a material selected from the group Table 6;
g) said ketone may comprise a material selected from the group Table 7;
h) said aldehyde may comprise a material selected from the group Table 8;
i) said hydrocarbon may comprise a material selected from the group Table 9;
j) said Schiff base may comprise a material selected from the group Table 10;
k) said waxes may comprise a material selected from the group consisting of carnauba wax, beeswax, paraffin, petrolatum, polytetrafluoroethylene wax, and mixtures thereof;
l) said natural and synthetic oils may comprise a material selected from the group consisting of lavender oil, cedarwood oil, vegetable oil, brominated oil, eucalyptol oil, Ylang Ylang oil, patchouli oil, bergamot oil and mixtures thereof.

In one aspect of said consumer product, said consumer product's particle may comprise a reaction product of an aldehyde with an amine.

In one aspect of said consumer product, said consumer product may comprise a material selected from the group consisting of a formaldehyde scavenger, a structurant, an anti-agglomeration agent and mixtures thereof.

In one aspect, the core of said consumer product's particle comprises at least a portion of said structurant.

In one aspect of said consumer product, said consumer product may comprise a formaldehyde scavenger.

In one aspect of said consumer product, said consumer product may comprise a structurant, said structurant may comprise a material selected from the group consisting of polysaccharides, modified celluloses, modified proteins, inorganic salts, quaternized polymeric materials, imidazoles; nonionic polymers having a pKa less than 6.0, polyurethanes, di-benzylidene polyol derivatives, acrylic polymers, cationic polymers and mixtures thereof.

In one aspect of said consumer product, said consumer product may comprise, based total consumer product weight, less than 85%, less than 60, less than 40%, less than 20% total water.

In one aspect of said consumer product, said consumer product may comprise, based total consumer product weight, from about 1% to about 85%, from about 3% to about 60%, from about 5% to about 40%, from about 5% to about 20% total water.

In one aspect of said consumer product, said consumer product may be a highly compacted consumer products, including highly compacted fabric and hard surface cleaning and/or treatment compositions, for example highly compacted detergents that may be solids or fluids, and may comprise water, based on total consumer product weight, at levels of from about 0.001% to about 20%, from about 0.01% to about 10%, from about 0.05% to about 5%, from about 0.1% to about 0.5%.

In one aspect of said consumer product, said consumer product may comprise a perfume delivery or any combination of perfume delivery systems described, for example, in USPA 2007/0275866 A1: Molecule-Assisted Delivery (MAD) systems; Fiber-Assisted Delivery (FAD) systems; Amine Assisted Delivery (AAD; Cyclodextrin Delivery System (CD); Starch Encapsulated Accord (SEA); Inorganic Carrier Delivery System (ZIC); Pro-Perfume (PP) including Amine Reaction Products (ARPs); and other Polymer Assisted Delivery (PAD) systems.

In addition to the foregoing aspects of said consumer product, aspects of Applicants consumer products may comprise/have any combination of characteristics and/or parameters disclosed in the present specification.

Organosilicones that may be suitable for use in the disclosed consumer product include organosilicones that may comprise Si—O moieties. Such organosilicones may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In one aspect, suitable organosilicones may have a viscosity of from about 10 to about 800,000 centistokes at 25° C. Suitable organosilicones may be linear, branched or cross-linked. In one aspect, the organosilicones may be linear.

In one aspect, the organosilicone may comprise a non-functionalized siloxane polymer that may have Formula I below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula I)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;
ii) n may be an integer from about 2 to about 10, or from about 2 to about 6; or 2; such that n=j+2;
iii) m may be an integer from about 5 to about 8,000, from about 7 to about 8,000 or from about 15 to about 4,000;
iv) j may be an integer from about 0 to about 10, or from about 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the trade names DC 200® Fluid, DC 1664, DC 349, DC 346G available from offered by Dow Corning Corporation, Midland, Mich., and those available under the trade names SF1202, SF1204, SF96, and Viscasil® available from Momentive Silicones, Waterford, N.Y.

In one aspect, the organo silicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759 A1, and U.S. Pat. Nos. 4,818,421 and 3,299,112. Exemplary commercially available silicone polyethers include DC 190, DC 193, FF400, all available from Dow Corning Corporation, and various Silwet surfactants available from Momentive Silicones.

In one aspect, the functionalized siloxane polymer may comprise an aminosilicone. Suitable aminosilicones are described in U.S. Pat. No. 7,335,630 B2, 4,911,852, and USPA 2005/0170994 A1. In one aspect, the aminosilicone may comprise the structure of Formula II:

$$[R_1R_2R_3SiO_{1/2}]_n[(R_4Si(X—Z)O_{2/2}]_k[R_4R_4SiO_{2/2}]_m[R_4SiO_{3/2}]_j \quad \text{(Formula II)}$$

wherein i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —$CH_2$—CH(OH)—$CH_2$—; and/or

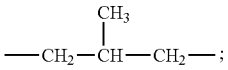

iii. Each Z may be independently selected from —$N(R_5)_2$; —$N(R_5)_3A^-$,

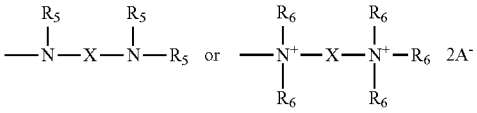

and/or

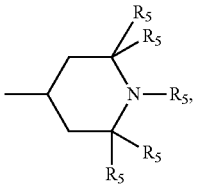

wherein each $R_5$ may be selected independently selected from H, $C_1$-$C_{20}$ alkyl, $C_1$-$C_{20}$ substituted alkyl, $C_6$-$C_{20}$ aryl, $C_6$-$C_{20}$ and/or substituted aryl, each $R_6$ may be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy; and $A^-$ may be a compatible anion. In one aspect, $A^-$ may be a halide;

iv. k may be an integer from about 3 to about 20, or from about 5 to about 18 more or from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from about 0 to about 10, or from about 0 to about 4, or 0;

In one aspect, $R_1$ may comprise —OH. In this aspect, the organosilicone may be amodimethicone.

Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 B2 and 7,273,837 B2. These are commercially available under the trade names Magnasoft® Prime, Magnasoft® JSS, Silsoft® A-858 (all from Momentive Silicones).

In one aspect, the functionalized siloxane polymer may comprise silicone-urethanes, such as those described in U.S. PA Ser. No. 61/170,150. These are commercially available from Wacker Silicones under the trade name SLM-21200.

When a sample of organosilicone is analyzed, it is recognized by the skilled artisan that such sample may have, on average, non-integer indices for Formula I and II above, but that such average indice values will be within the ranges of the indices for Formula I and II above.

Suitable hydrophobic organic materials are listed in Tables 1-10 below.

TABLE 1

Examples of alcohols

| Name | CAS |
|---|---|
| Lauryl alcohol | 112-53-8 |
| Citronellol | 106-22-9 |
| Alpha-terpineol | 98-55-5 |
| 2-tert-butylcyclohexanol | 13491-79-7 |
| 2,6-dimethyl-2-octanol | 18479-57-7 |
| 3,7-dimethyl-3-octanol and 2,6-dimethyl-2-octanol | 78-69-3/18479-57-7 |
| 2-methyl-4-(2,2,3-trimethyl-3-cyclopentenyl)-2-buten-1-ol | 28219-60-5 |
| linalool | 78-70-6 |
| Tetrahydrolinalool | 78-69-3 |

TABLE 2

Examples of esters

| Name | CAS |
|---|---|
| Methyl laurate | 111-82-0 |
| Methyl jasmonate | 39924-52-2 |
| Hexyl isovalerate | 10032-13-0 |
| Geranyl acetate | 16409-44-2 |
| 1,4-dioxacyclohexadecane-5,16-dione | 54982-83-1 |
| 4-tert-butylcyclohexyl acetate | 32210-23-4 |

TABLE 2-continued

| Examples of esters | |
|---|---|
| Name | CAS |
| 3,5,5-trimethylhexyl acetate | 58430-94-7 |
| Ethyl-2-methylpentanoate | 39255-32-8 |
| Ethyl Methyl-2-Butyrate | 7452-79-1 |
| Isopropyl myristate | 110-27-0 |

TABLE 3

| Examples of ethers | |
|---|---|
| Name | CAS |
| (3z)-1-[(2-methyl-2-propenyl)oxy]-3-hexene | 292605-05-1 |
| decahydrospiro[furan-2(3h),5'-[4.7]methano[5h[indene] | 68480-11-5 |
| 4,9,12,12-tetramethyl-5-oxatricyclo[8.2.0.0(4,6)]dodecane | 1209-61-6 |
| decahydro-2,6,6,7,8,8-hexamethyl-2h-indeno[4,5-b]furan (and isomers there of) | 338735-71-0/ 351343-77-6 |
| 2-(1-ethylpentyl)-1,3-dioxolane | 4359-47-1 |
| 2-methyl-1,5-dioxaspiro[5.5]undecane | 6413-26-9 |
| phenyl ethyl cyclohexyl ether | 80858-47-5 |

TABLE 4

| Examples of carboxylic acids | |
|---|---|
| Name | CAS |
| Lauric acid | 143-07-7 |
| Myristic acid | 544-63-8 |
| 2,4-dimethoxybenzoic acid | 91-52-1 |
| 2,4-dimethyl-2-pentenoic acid | 21016-46-6 |
| geranic acid | 459-80-3 |
| salicylic acid | 69-72-7 |
| Cyclohexylacetic acid | 5292-21-7 |

TABLE 5

| Examples of nitriles | |
|---|---|
| Name | CAS |
| Lauryl nitrile | 2437-25-4 |
| 2-phenyl hexanenitrile | 3508-98-3 |
| methyl 2-[{(4-(4-hydroxy-4-methylpentyl)-1-cyclohexenyl)methylene}amino}benzoate | 67634-12-2 |
| 2,2,4-trimethyl-4-phenyl-butanenitrile | 75490-39-0 |
| 3,7-dimethyloctanenitrile | 40188-41-8 |
| (e)-3-phenyl-2-propenenitrile | 1885-38-7 |
| 3,7-dimethyl-6-octenenitrile | 51566-62-2 |

TABLE 6

| Examples of amines | |
|---|---|
| Name | CAS |
| 4-(4,8-dimethyl-3,7-nonadienyl) pyridine | 38462-23-6 |
| (2-methylpropyl)-quinoline | 1333-58-0 |
| | 89-43-0 |

TABLE 7

| examples of ketones | |
|---|---|
| Name | CAS |
| Dihydrojasmone | 1128-08-1 |
| Methyl-beta-ionone | 127-43-5 |
| Methyl heptenone | 110-93-0 |
| 6,10-dimethylundecen-2-one | 1322-58-3 |
| 1,3,4,6,7,8a-hexahydro-1,1,5,5-tetramethyl-2h-2,4a-methanonaphthalen-8(5h)-one | 23787-90-8 |
| 5-Cyclohexadecen-1-one | 37609-25-9 |
| Ionone | 8013-90-9 |

TABLE 8

| Examples of aldehydes | |
|---|---|
| Name | CAS |
| Lauric aldehyde | 112-54-9 |
| Amyl Cinnamic Aldehyde | 122-40-7 |
| 3,6(and 4,6)-dimethylcyclohex-3-ene-1-carboxaldehyde | 27939-60-2 |
| 2,4-dimethyl-3-cyclohexene-1-carboxaldehyde | 68039-49-6 |
| 1-methyl-4-(4-methyl-3-pentenyl)cyclohex-3-ene-1-carboxaldehyde | 52474-86-2 |
| 3-(and 4-)(4-methyl-3-pnetyl)cyclohex-3-ene-1-carboxaldehyde | 37677-14-8/ 52475-89-5 |
| ((3,7,-dimethyl-6-octenyl)oxy)acetaldehyde | 7492-67-3 |

TABLE 9

| Examples of hydrocarbons | |
|---|---|
| Name | CAS |
| isolongifolene | 1135-66-6 |
| Limonene | 5989-27-5 |
| Terpinolene | 586-62-9 |
| 3,7-dimethyl-1,3,6-octatriene | 13877-91-3 |
| Bisabolene | 17627-44-0, 502-61-4, 18794-84-8 |
| Alpha-pinene | 80-56-8 |

TABLE 10

| Examples of Schiff bases | |
|---|---|
| Name | CAS |
| Methyl anthranilate/citronellal Schiff Base | 67845-42-5 |
| Isononylaldehyde/methylanthranilate Schiff Base | 67801-42-7 |
| Methyl N-(3,7-dimethyl-7-hydroxyoctylidene)-anthranilate | 89-43-0 |

Such materials may be used alone or in any combination. Thus, it is understood that, mixtures thereof are disclosed.

The suitable materials and equipment for practicing the present invention may be obtained from: United Initiators, GmbH & Co. KG, Dr.-Gustav-Adolph-Str.3, 82049 Pullach, Germany; Emerson Resources INC, Suite 1, 600 Markley Street, Norristown, Pa. 19401, United States; Appleton, 825 E Wisconsin Avenue, P.O. Box 359, WI 54912-0359, United States; Sigma Aldrich NV/SA, Kardinaal Cardijnplein 8, 2880 Bornem, Belgium; ProCepT nv, Rosteyne 4, 9060 Zelzate, Belgium; Ingeniatrics, Avd. Américo Vespucio 5-4, 1ªp., mód. 12, Sevilla, Spain; GEA Process Engineering Inc. •9165 Rumsey Road•Columbia, Md. 21045, United States; Mettler-Toledo, Inc., 1900 Polaris Parkway, Columbus, Ohio, 43240, United States; IKA-Werke GmbH & Co. KG, Janke & Kunkel Str. 10, 79219 Staufen, Germany; Alfa Aesar GmbH & Co KG, Zeppelinstrasse 7, 76185 Karlsruhe, Germany; Netzsch-Condux Mahltechnik GmbH, Rodenbacher Chaussee 1, 63457 Hanau, Germany; International Flavors & Fragrances, Global Headquarters, 521 West 57th Street, 10019 New York, United States; Firmenich SA—Corporate Headquarters, Rue de la Bergère 7, P.O. Box 148, Meyrin 2 CH-1217, Switzerland; Corporate Headquarters Givaudan SA, 5, chemin de la parfumerie, 1214 Vernier, Switzerland.

Process of Making Consumer Products

A process of making a consumer product, comprising a consumer product adjunct material and a particle is disclosed, said process may comprise:

a.) preparing a first solution comprising, based on total solution weight, from about 10% to about 90%, a first emulsifier and a first resin, the ratio of said first emulsifier and said first resin being from about 0.1:1 to about 10:1;

b.) adjusting the pH of the first solution to be in the range of from about pH 4.5 to pH 6;

c.) preparing a second solution comprising based on total solution weight from about 10% to about 95% water, a second emulsifier and a second resin, the ratio of said second emulsifier and said second resin being from about 0:1 to about 3:1;

d.) adjusting the pH of the second solution to be in the range of from pH 4 to pH 6;

e.) preparing a core material comprising a solid water soluble benefit agent, a protective suspension agent having a viscosity having a viscosity, at 25° C., of at least 500 centistokes, and, optionally, a hydrophobic organic material, said protective suspension agent coating said solid water soluble benefit agent;

f.) combining said core material and said first solution to form a first composition;

g.) emulsifying said first composition;

h.) combining said first composition and said second solution to form a second composition and optionally combining any processing aids and said second composition;

i.) mixing said second composition for at least 15 minutes at a temperature of from about 25° C. to about 100° C. and optionally combining any processing aids to said second composition;

j.) optionally combining any scavenger material, structurant, salts and/or anti-agglomeration agent with said second composition during step i.) or thereafter k.) optionally spray drying or agglomerating said second composition;

l.) combining said second composition with one or more consumer product adjuncts. In one aspect of the aforementioned process, said process may comprise:

a.) preparing a first solution comprising, based on total solution weight, from about 20% to about 90%, a first emulsifier and a first resin, the ratio of said first emulsifier and said first resin being from about 0.1:1 to about 10:1;

b.) adjusting the pH of the first solution to be in the range of from about pH 5 to pH 6;

c.) preparing a second solution comprising based on total solution weight from about 20% to about 95% water, a second emulsifier and a second resin, the ratio of said second emulsifier and said second resin being from about 0:1 to about 3:1;

d.) adjusting the pH of the second solution to be in the range of from pH 4 to pH 5;

e.) preparing a core material comprising a solid water soluble benefit agent, a protective suspension agent having a viscosity, at 25° C., of from about 500 centistokes to about 2,000,000 centistokes, from about 1000 centistokes to about 800,000 centistokes or even from about 1000 centistokes to about 300,000 centistokes, preferably said protective suspension agent comprises a silicone material having a viscosity of at least 30,000 centistokes, more preferably from about 30,000 to about 60,000 and an optional hydrophobic organic material, said protective suspension agent coating said solid water soluble benefit agent f.) combining said core material and said first solution to form a first composition;

g.) emulsifying said first composition;

h.) optionally combining said first composition and said second solution to form a second composition and optionally combining any processing aids and said second composition;

i.) mixing said combined first composition second composition for at least 15 minutes at a temperature of from about 25° C. to about 100° C. and optionally combining any processing aids to said second composition;

j.) optionally combining any scavenger material, structurant, salts and/or anti-agglomeration agent with said second composition during step i.) or thereafter k.) optionally spray drying or agglomerating said second composition.

Adjunct Materials

For the purposes of the present invention, the non-limiting list of adjuncts illustrated hereinafter are suitable for use in the instant compositions and may be desirably incorporated in certain embodiments of the invention, for example to assist or enhance performance, for treatment of the substrate to be cleaned, or to modify the aesthetics of the composition as is the case with perfumes, colorants, dyes or the like. It is understood that such adjuncts are in addition to the components supplied by the recited particle. The precise nature of these additional components, and levels of incorporation thereof, will depend on the physical form of the composition and the nature of the operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, external structuring system, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1 that are incorporated by reference.

Each adjunct ingredient is not essential to Applicants' compositions. Thus, certain embodiments of Applicants' compositions do not contain one or more of the following adjuncts materials: bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, external structuring system, fabric softeners, carriers, hydrotropes, processing aids and/or pigments. It is understood that such adjuncts may form a product matrix that is combined with the encapsulates disclosed herein to form a finished consumer product. Generally, when one or more adjuncts are present, such one or more adjuncts may be present as detailed below:

Surfactants—The compositions according to the present invention can comprise a surfactant or surfactant system wherein the surfactant can be selected from nonionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

Builders—The compositions of the present invention can comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The compositions herein may also optionally contain one or more copper, iron and/or manganese chelating agents. If utilized, chelating agents will generally comprise from about 0.1% by weight of the compositions herein to about 15% or even from about 3.0% to about 15% by weight of the compositions herein.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions of the present invention can also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Catalytic Metal Complexes—Applicants' compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methyl-enephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. Nos. 5,597,936 and 5,595,967. Such cobalt catalysts are readily prepared by known procedures, such as taught for example in U.S. Pat. Nos. 5,597,936, and 5,595,967.

Compositions herein may also suitably include a transition metal complex of a macropolycyclic rigid ligand—abbreviated as "MRL". As a practical matter, and not by way of limitation, the compositions and cleaning processes herein can be adjusted to provide on the order of at least one part per hundred million of the benefit agent MRL species in the aqueous washing medium, and may provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include manganese, iron and chromium. Suitable MRL's herein are a special type of ultra-rigid ligand that is cross-bridged such as 5,12-diethyl-1,5,8,12-tetraazabicyclo[6.6.2]hexa-decane.

Suitable transition metal MRLs are readily prepared by known procedures, such as taught for example in U.S. Pat. No. 6,225,464.

External structuring system—The composition of the present invention may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear (0.05 $s^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C. In one embodiment, the compositions may comprise from 0.01 to 1% by weight of a non-polymeric crystalline, hydroxyl functional structurant. Such non-polymeric crystalline, hydroxyl functional structurants may comprise a crystallizable glyceride which can be pre-emulsified to aid dispersion into the final unit dose laundry detergent composition. Suitable crystallizable glycerides include hydrogenated castor oil or "HCO" or derivatives thereof, provided that it is capable of crystallizing in the liquid detergent composition.

Unit dose laundry detergent compositions may comprise from 0.01 to 5% by weight of a naturally derived and/or synthetic polymeric structurant. Suitable naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable synthetic polymeric structurants include: polycarboxylates, polyacrylates, hydrophobically modified ethoxylated urethanes, hydrophobically modified non-ionic polyols and mixtures thereof. In one aspect, the polycarboxylate polymer may be a polyacrylate, polymethacrylate or mixtures thereof. In another aspect, the polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

Method of Use

Certain of the consumer products disclosed herein can be used to clean or treat a situs inter alia a surface or fabric. Typically at least a portion of the situs is contacted with an embodiment of Applicants' consumer product, in neat form or diluted in a liquor, for example, a wash liquor and then the situs may be optionally washed and/or rinsed. In one aspect, a situs is optionally washed and/or rinsed, contacted with an aspect of the consumer product and then optionally washed and/or rinsed. For purposes of the present invention, washing includes but is not limited to, scrubbing, and mechanical agitation. The fabric may comprise most any fabric capable of being laundered or treated in normal consumer use conditions. Liquors that may comprise the disclosed compositions may have a pH of from about 3 to about 11.5. Such compositions are typically employed at concentrations of from about 500 ppm to about 15,000 ppm in solution. When the wash solvent is water, the water temperature typically ranges from about 5° C. to about 90° C. and, when the situs comprises a fabric, the water to fabric ratio is typically from about 1:1 to about 30:1.

The employing one or more of the aforementioned methods result in a treated situs.

Test Methods

It is understood that the test methods that are disclosed in the Test Methods Section of the present application should be used to determine the respective values of the parameters of Applicants' invention as such invention is described and claimed herein.

(1) Fracture Strength a.) Place 1 gram of particles in 1 liter of distilled deionized (DI) water.

b.) Permit the particles to remain in the DI water for 10 minutes and then recover the particles by filtration, using a 60 mL syringe filter, 1.2 micron nitrocellulose filter (Millipore, 25 mm diameter).

c.) Determine the rupture force of 50 individual particles. The rupture force of a particle is determined using the procedure given in Zhang, Z.; Sun, G; "Mechanical Properties of Melamine-Formaldehyde microcapsules," *J. Microencapsulation*, vol. 18, no. 5, pages 593-602, 2001. Then calculate the fracture strength of each particle by dividing the rupture force (in Newtons) by the cross-sectional area of the respective spherical particle ($\pi r^2$, where r is the radius of the particle before compression), said cross-sectional area being determined as follows: measuring the particle size of each individual particle using the experimental apparatus and method of Zhang, Z.; Sun, G; "Mechanical Properties of Melamine-Formaldehyde microcapsules," *J. Microencapsulation*, vol 18, no. 5, pages 593-602, 2001.

d.) Use the 50 independent measurements from c.) above, and calculate the percentage of particles having a fracture strength within the claimed range fracture strength range.

(2) ClogP

The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor, and C. A. Ramsden, Eds. P. 295, Pergamon Press, 1990, incorporated herein by reference). ClogP values may be calculated by using the "CLOGP" program available from Daylight Chemical Information Systems Inc. of Irvine, Calif. U.S.A.

(3) Particle Size a.) Place 1 gram of particles in 1 liter of distilled deionized (DI) water.

b.) Permit the particles to remain in the DI water for 10 minutes and then recover the particles by filtration, using a 60 mL syringe filter, 1.2 micron nitrocellulose filter (Millipore, 25 mm diameter).

c.) Determine the particle size of 50 individual particles using the experimental apparatus and method of Zhang, Z.; Sun, G; "Mechanical Properties of Melamine-Formaldehyde microcapsules," *J. Microencapsulation*, vol. 18, no. 5, pages 593-602, 2001.

d.) Use the 50 independent measurements from c.) above, and calculate the percentage of particles having a particle size within the claimed range.

(4) Particle Wall Thickness

All references to Leica Microsystems refer to the Company with Corporate Headquarters located at:
Leica Microsystems GmbH
Ernst-Leitz-Strasse 17-37
35578 Wetzlar All references to Drummond refer to the Company located at:
Drummond Scientific Company
500 Parkway, Box 700
Broomall, Pa. 19008

All references to Hitachi refer to the Company with Corporate Headquarters located at:
Hitachi High Technologies
24-14, Nishi-Shimbashi 1-chome,Minato-ku,
Tokyo 105-8717,Japan All references to Gatan refer to the Company with Corporate Headquarters located at:
Gatan, Inc.
5933 Coronado Lane
Pleasanton, Calif. 94588

All references to Quartz refer to the Company with offices located at:
Quartz Imaging Corporation
Technology Enterprise Facility III
6190 Agronomy Rd, Suite 406
Vancouver, B.C. Canada V6T 1Z3

Materials:

Methylcyclohexane—Alfa Aesar Catalogue Number A16057 or equivalent

Capillary Pipettes—Drummond Catalogue Number 5-000-1005 or equivalent

Flat Specimen Carrier—Leica Microsystems P/N 706897 or equivalent

Copper Washers—Leica Microsystems P/N 706867 or equivalent

Flat Specimen Pod—Leica Microsystems P/N 706839 or equivalent

Loading Device for Flat Specimen Holder—Leica Microsystems P/N 706832 or equivalent Torque Wrench—Leica Microsystems P/N 870071 or equivalent Allen Bit, 2 mm—Leica Microsystems P/N 870072 or equivalent Forceps—Leica Microsystems P/N 840105 or equivalent Gatan Planchette Collet—Gatan P/N PEP5099

Gatan Planchette Specimen Holder—Gatan P/N PEP1395

Instruments:

Scanning Electron Microscope—Hitachi Model S-5200 SEM/STEM or equivalent

High Pressure Freezer—Leica Microsystems Model 706802 EM Pact or equivalent

Cryotransfer Device—Gatan Model CT3500 or equivalent

Cryotransfer System—Gatan Model CT2500 or equivalent

Gatan ITC Temperature Controller—Gatan Model ITC502 or equivalent

Image Analysis Software—Quartz PCI Version 5 or equivalent

Sample: Obtain the sample of microcapsules as per the procedure of 1 above entitled "Fracture Strength". 50 samples are required.

Test Procedure

1) Turn on the Leica Microsystems High Pressure Freezer (Leica Microsystems Model Number 706802).
2) Fill up the methylcyclohexane container on the High Pressure Freezer with methylcyclohexane (Alfa Aesar Cat. # A16057 or equivalent).
3) Fill up the liquid nitrogen dewar on the High Pressure Freezer.
4) Fill the liquid nitrogen bath on the High Pressure Freezer
5) The display on the High Pressure Freezer will show Load Sample on the front panel when the instrument is ready to use.
6) Start the Hitachi Model S-5200 SEM/STEM and set the Accelerating Voltage to 3.0 KV and the Emission Current to 20 μA.
7) Fill the Anti-contaminator Dewar located on the lower right side of the Hitachi Model S-5200 SEM/STEM microscope column with liquid nitrogen.
8) Fill the liquid nitrogen dewar on the Gatan Alto 2500 Cryotransfer System (Gatan Model CT2500). Replenish the liquid nitrogen until the dewar remains full. The device is ready to use when the prepchamber temperature reads below −190° C.
9) Place a copper washer (Leica Microsystems P/N 706867) on top of the flat specimen carrier such that the hole in the washer aligns with the well in the flat specimen carrier.
10) Take a glass capillary pipette (Drummond P/N 5-000-1005 or similar) and insert the provided wire plunger into one end of the pipette
11) Insert the pipette into the microcapsule dispersion and withdraw the plunger part way to pull a few microliters of the dispersion into the pipette.
12) Place the tip of the pipette in the well in the flat specimen carrier and push the plunger into the pipette to dispense a small amount of liquid until the well is just slightly overfilled.
13) Insert a 2 mm Allen key bit (Leica Microsystems P/N 870072) into the torque wrench (Leica Microsystems P/N 870071).
14) Using the torque wrench with the bit, loosen the Diamond Locking Screw in the Flat Specimen Pod (Leica Microsystems P/N 706839).
15) Place the Flat Specimen Holder and Copper Washer into the Flat Specimen Pod.
16) Use the torque wrench with the 2 mm Allen key bit to tighten the Diamond Locking Screw in the Flat Specimen Pod onto the specimen until the torque wrench clicks twice.
17) Attach the Loading Device for the Flat Specimen Holder (Leica Microsystems P/N 706832) to the Flat Specimen Pod by screwing it onto the exposed threads of the Diamond Locking Screw.
18) Place the Loading Device for the Flat Specimen Holder with the Flat Specimen Pod onto the EM Pact High Pressure Freezer (Leica Microsystems P/N 706802) and insert it into the High Pressure Freezer.
19) Freeze the specimen using the High Pressure Freezer.
20) Transfer the Flat Specimen Pod to the Unloading Station and unscrew the Loading Device for the Flat Specimen Carrier being careful to keep it immersed in the liquid nitrogen bath.
21) Using the torque wrench, loosen the Diamond Locking Screw.
22) Using tweezers with the tips cooled in liquid nitrogen until the liquid nitrogen stops boiling, remove the Flat Specimen Carrier from the Flat Specimen Pod and place it into a small container in the liquid nitrogen bath.
23) Place the Gatan CT3500 Cryotransfer Device (Gatan Model Number CT3500) into the Gatan Specimen Workstation.
24) Fill the liquid nitrogen dewar on the Gatan CT3500 Cryotransfer device and fill the dewar on the Gatan Specimen Workstation replenishing the liquid nitrogen as necessary until rapid boiling of the liquid nitrogen stops.
25) Transfer the Flat Specimen Holder to the Gatan Specimen Workstation while keeping it in a container of liquid nitrogen.
26) Using tweezers cooled in liquid nitrogen until the liquid nitrogen stops boiling, place the flat specimen holder into the Gatan Planchette Collet (Gatan P/N PEP5099) and press down firmly.
27) Place the assembly from step 26 into the Gatan Planchette Specimen Holder (Gatan P/N PEP1395) and press down firmly.
28) Push the Gatan Cryotransfer device back into the Gatan Specimen Workstation.
29) Using the Gatan supplied 5 mm Friction Tool, screw the Gatan Planchette Specimen Holder into the Gatan Cryotransfer device.
30) Remove the Gatan Cryotransfer device from the Gatan Specimen Workstation and insert it into the Gatan Alto 2500 Cryotransfer System.
31) Attach the Gatan ITC Temperature Controller (Gatan Model Number ITC502) to the Gatan Cryotransfer device by attaching the Temperature Measurement Lead from the Gatan ITC controller to the connector on top of the Gatan Cryotransfer device.

32) Using the Gatan ITC Controller, raise the temperature of the specimen to −120° C.
33) Using the fracturing knife, break off the copper washer to fracture the specimen.
34) Reduce the temperature of the specimen below −160° C.
35) With the voltage set to 6 KV and the gas flow set to provide 10 mA sputter current, press the sputter button and once the current displays 10 mA, let the coater run for 60-90 seconds coating the specimen with gold/palladium.
36) Close the frost shield on the Gatan CT3500 Cryotransfer Device and transfer the specimen to the Hitachi S-5200 SEM/STEM.
37) Wait for the temperature of the Gatan CT3500 Cryotransfer device to stabilize, typically between −170° C. and −172° C.
38) Open the frost shield on the Gatan CT3500 Cryotransfer device by turning the frost shield control knob counter-clockwise.
39) Move the sample around using the stage control trackball, locate a broken microcapsule and adjust the magnification to 50,000 to 150,000×.
40) Adjust the focus and stigmation controls to obtain the best image.
41) Acquire an image of the cross-section of the capsule wall.

Calculations

1) Select the ruler tool in the Quartz PCI software.
2) Move the cursor to one edge of the microcapsule wall.
3) Click and hold the left mouse button while dragging the mouse cursor to the opposite side of the capsule wall keeping the drawn line perpendicular to the face of the capsule wall to measure the wall thickness.
4) Use 50 independent measurements (1 measurement for each capsule) to calculate the percentage of particles having a wall thickness in the claimed range.

(5) Solid, Water Soluble Benefit Agent Release Test

Material and instruments needed:

1. launder-o-meter (launder-o-meter procedures are described in the Technical Manual of the AATCC)
2. Test pieces of soiled fabric 10×10 cm as described in JAOCS, Vol. 66, n.1 (January 1989)
3. A canister of 50 steel balls of 6 mm diameter
4. Industrial water (2.5 mmol/L hardness)
5. Detergent composition containing particles having a core comprising a benefit agent.

Procedure:

Prepare a stainless-steel launder-o-meter container and add 250 mL of water at 30° C., 2.5 grams of a liquid detergent composition containing particles containing a benefit agent, three test pieces of soiled fabric 10×10 cm and 50 steel balls. Containers are place in the launder-ometer and they are rotated for 40 minutes at 42 rpm. After 5, 8 and 10 minutes a sample is taken for analytical measurement of the benefit agent. The analysis is preformed in accordance with the applicable protocol that is listed below:

A. Analytical Test for Preformed Peracids, Bleach Activators and Hydrogen Peroxide Sources:

The bleach component liberates iodine from an acified potassium iodide solution. The free iodine is titrated potentiometrically with a standardized thiosulphate solution $$\text{Bleach component} + 2I^- + 2H^+ \rightarrow I_2 + 2H_2O \quad [1]$$

$$I_2 + I^- \leftrightarrow I_3^- \quad [2]$$

$$I_3 + 2S_2O_3 2^- \rightarrow 3I + S_4O_6 \quad [3]$$

The bleach component can be a hydrogen peroxide source, a preformed peracid or a peracid generated from a bleach activator. The method measures the total amount of bleach. In case the bleach is generated from a bleach activator reacting with hydrogen peroxide, Catalase needs to be added after the peracid generation. Catalase destroys hydrogen peroxyde without influencing the peracid and only the peracid is present for further analysis.

Equipment:

Autotitrator (fe Metrohm 809) connected to a PC
Redox electrode (fe Metrohm 6.0431.100)

Chemicals:

Glacial Acetic Acid (VWR 1.00063)
KI 3 M (Sigma Aldrich 35175)
$Na_2S_2O_3$ 0.01 N (38243, Sigma Aldrich)
Catalase from bovine lever Fluka Biochemica 60640±260000 U/mL
10% Sodium percarbonate aqueous solution. In order to prepare this solution, add 100 g sodium percarbonate (VWR ALFAA16045) to 900 mL demi-water under continuous stirring.

Procedure:

1. Hydrogen peroxide sources and preformed peracids in absence of peroxides:

a. weigh×grams of sample in order to have between 0.05 and 0.40 grams of pure material.
b. Add 50 mL water
c. Add 10 mL of acetic acid.
d. Stir for 1 minute
e. Add 4 mL of KI solution
f. Titrate with $Na_2S_2O_3$ with the redox electrode until the first equivalent point
g. Calculate the amount of peroxide/peracid:

$$\%\ \text{Peracid/peroxides} = \frac{V \cdot N \cdot M_w}{G \cdot 20}$$

wherein V is the measured volume in mL, N is the normality of the sodium thiosulfate solution, Mw the molecular weight of the preformed peracid or the hydrogen peroxide source and G the grams, based on 100% purity, of preformed peracid or hydrogen peroxide source weight for the titration 2. In situ formed peracids (in situ reaction of hydrogen peroxide and a bleach activator)

a. Weigh x grams of sample in order to have between 0.05 and 0.40 grams of pure material.
b. Add 50 mL of percarbonate solution
c. Stir for 10 minutes (to enable peracid formation)
d. Add 0.5 mL of Catalase
e. Stir for at least 1 minute (maximum 5 minutes)\
f. Add 10 mL of acetic acid
g. Add 4 mL KI solution
h. Titrate with $Na_2S_2O_3$ with the redox electrode until the first equivalent point
i. Calculate the amount of peracid:

$$\%\ \text{Peracid} = \frac{V \cdot N \cdot M_w}{G \cdot 20}$$

wherein V is the measured volume in mL, N is the normality of the sodium thiosulfate solution, Mw the molecular weight of the bleach activator and G the grams, based on 100% purity, of bleach activator weight for the titration B. Analytical Test for Metal Catalysts: Photometric Method The activity of the bleach catalyst is measured by means of a colorimetric reaction with a specific dye.

a. Preparation of a calibration curve: Add 40 μL of a 10,000 ppm detergent solution like the ones described in examples 7, 8 and 9, without particles containing X ppm of the metal catalyst in deionized water to 150 μL of Chicago sky blue reagent and incubate at 37° C. for 3 minutes (see table below). After incubation an absorbance measure of the solution of detergent and dye is made at 600 nm (Abs 1). Add 60 μL of the hydrogen peroxide reagent to the solution and incubate at 37° C. for 30 minutes. Measure the absorbance of this solution at 600 nm after incubation (Abs 2). Repeat this with different levels of metal catalyst according to following table:

| Sample | X ppm metal catalyst | Abs 1 | Abs 2 | ABS = Abs 1 − Abs 2 |
|---|---|---|---|---|
| 0 | 0 | | | |
| 1 | 0.05 | | | |
| 2 | 0.10 | | | |
| 3 | 0.20 | | | |
| 4 | 0.30 | | | |
| 5 | 0.40 | | | |
| 6 | 0.50 | | | |
| 7 | 0.60 | | | |
| 8 | 0.80 | | | |
| 9 | 1.00 | | | |
| 10 | 1.25 | | | |
| 11 | 1.50 | | | |
| 12 | 1.75 | | | |
| 13 | 2.00 | | | |
| 14 | 2.50 | | | |
| 15 | 3.00 | | | |

Subtract the initial measured absorbance (Abs 1) from the final (Abs 2) and plot a calibration curve (polynomial fit).

b. Measure 40 μL of the sampled wash solution and determine the concentration of metal catalyst in the wash by using the calibration curve.

c. Determine the percentage of release:

$$\% \text{ Release} = \frac{C_{wash}}{C_{total}} \times 100$$

wherein $C_{wash}$ is the concentration of metal catalyst determined in the wash in ppm and $C_{total}$ is the total amount of metal catalyst in the wash in ppm (total encapsulated).

C. Analytical test for non-metal catalysts: Isoquinolinium class materials and the activated intermediate can be measured by mass spectrometry. Depending upon the response of the individual molecule, electrospray mass spectrometry operated in positive or negative ion is used to measure the isoquinolinium and the oxized intermediate. MS analysis is done either by direct infusion or by injecting discrete amounts of diluted sample (flow injection analysis). No HPLC separation is needed.

a. Eluens: acetonitrile:water (1/1)+lmmol ammonium acetate.

b. Instrument settings are optimized for individual molecules to obtain maximum response.

c. Subsequent measurements are done either in selective ion mode or multiple reaction monitoring.

d. Samples are diluted in acetonitrile/water 1/1+1 mmol ammonium acetate. Dilution factor depends upon concentration of the isoquinolinium.

e. MS setup: electrospray in either positive or negative ion mode. When full scan acquisition is desired, both scan modes alternated.

Percentage of release is calculated using the same formula as described above for metal catalysts.

D. Analytical test for diacyl peroxides: Diacyl peroxides are measured by means of HPLC separation followed by electrochemical detection. A short chain RP column is used for the separation, 5 μm, 250 mm*4.6 mm A typical eluent is water/acetonitrile (250 mL/850 mL) with 0.0025 M ammonium dihydrogen phosphate. The flow rate is set up to 10 mL/min and the detection is done by DC amperometry or colometry. Samples are diluted in a mixture of acetonitrile and acetic acid glacial in a ratio of 90% acetonitrile and 10% acetic acid glacial prior to analysis. Percentage of release is calculated using the same formula as described above for metal catalysts E. Enzyme Release may be Measured using ASTM Method D0348-89 (2003).

(6) Water Solubility Test

Water solubility is measured using ASTM method E1148-02(2008)

(7) Solid Particle Size Test

Solid, water soluble benefit agent particle size may be measured using ASTM method E2651-10

EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Example 1

Making an Encapsulate 35 grams of butyl acrylate-acrylic acid copolymer and acrylic acid emulsifier (Colloid C351, 25% solids, pka 4.5-4.7, Kemira Chemicals, Inc. Kennesaw, Ga. U.S.A.) are dissolved and mixed in 200 grams deionized water. The pH of the solution is adjusted to pH of from 5 to 6 with sodium hydroxide solution. 8 grams of partially methylated methylol melamine resin (Cymel 385, 80% solids, Cytec Industries West Paterson, N.J., U.S.A.) are added to the emulsifier solution. 200 grams of a suspension formed by a solid, water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands (with 99% of the particles having a particle size of 3.65 microns), a polysiloxane (Dow Corning 200® 60,000 centistokes, Dow Corning) and a hydrophobic organic composition formulated with materials listed in Tables 1 to 10, is added to the previous mixture under mechanical agitation. After mixing until a stable suspension is obtained, the second solution and 7 grams of sodium sulfate salt are added to emulsify the mixture. This second solution contains 4 grams of poly-acrylic acid emulsifier, 120 grams of distilled water, 12 grams of partially methylated methylol melamine resin. This mixture is heated to 70° C. and kept at such temperature for at 2 hours with continuous stirring to complete encapsulation. 18 grams of acetoacetamide (Sigma-Aldrich, Saint Louis, Mo., U.S.A.) are added to the suspension. An average capsule size of 40 microns is obtained as analyzed by the method described above.

Example 2

35 grams of butyl acrylate-acrylic acid copolymer and acrylic acid emulsifier (Colloid C351, 25% solids, pka 4.5-4.7, Kemira Chemicals, Inc. Kennesaw, Ga. U.S.A.) are dissolved and mixed in 200 grams deionized water. The pH of the solution is adjusted to pH of from 5 to 6 with sodium hydroxide solution. 8 grams of partially methylated methylol melamine resin (Cymel 385, 80% solids, Cytec Industries West Paterson, N.J., U.S.A.) are added to the emulsifier solution. 200 grams of a suspension formed by a solid, water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands (with 99% of the particles having a particle size of 4.56 microns), a polysiloxane (Dow Corning 200® 60,000 centistokes, Dow Corning) and a hydrophobic organic composition formulated with materials listed in Tables 1 to 10, is added to the previous mixture under mechanical agitation. After mixing until a stable suspension is obtained, the second solution and 7 grams of sodium sulfate salt are added to emulsify the mixture. This second solution contains 4 grams of poly-acrylic acid emulsifier, 120 grams of distilled water, 12 grams of partially methylated methylol melamine resin. This mixture is heated to 70° C. and kept at such temperature for 1 hour with continuous stirring to complete encapsulation. 18 grams of acetoacetamide (Sigma-Aldrich, Saint Louis, Mo., U.S.A.) are added to the suspension. An average capsule size of 50 microns is obtained as analyzed by the method described above.

Example 3

35 grams of butyl acrylate-acrylic acid copolymer and acrylic acid emulsifier (Colloid C351, 25% solids, pka 4.5-4.7, Kemira Chemicals, Inc. Kennesaw, Ga. U.S.A.) are dissolved and mixed in 200 grams deionized water. The pH of the solution is adjusted to pH of from 5 to 6 with sodium hydroxide solution. 8 grams of partially methylated methylol melamine resin (Cymel 385, 80% solids, Cytec Industries West Paterson, N.J., U.S.A.) are added to the emulsifier solution. 200 grams of a suspension formed by a solid, water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands (with 99% of the particles having a particle size of 5.43 microns), a polysiloxane (Dow Corning 200® 60,000 centistokes, Dow Corning) and a hydrophobic organic composition formulated with materials listed in Tables 1 to 10, is added to the previous mixture under mechanical agitation. After mixing until a stable suspension is obtained, the second solution and 7 grams of sodium sulfate salt are added to emulsify the mixture. This second solution contains 4 grams of poly-acrylic acid emulsifier, 120 grams of distilled water, 12 grams of partially methylated methylol melamine resin. This mixture is heated to 70° C. and kept at such temperature for 4 hours with continuous stirring to complete encapsulation. 18 grams of acetoacetamide (Sigma-Aldrich, Saint Louis, Mo., U.S.A.) are added to the suspension. An average capsule size of 30 microns is obtained as analyzed by the method described above.

Example 4

35 grams of butyl acrylate-acrylic acid copolymer (Colloid C351, 25% solids, pka 4.5-4.7, Kemira Chemicals, Inc. Kennesaw, Ga. U.S.A.) are dissolved and mixed in 200 grams deionized water. The pH of the solution is less than 5, i.e 4.5. 200 grams of a suspension formed by a solid, water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands (with 99% of the particles having a particle size of 3.65 microns), a polysiloxane (Dow Corning 200® 1,000 centistokes, Dow Corning), is added to the previous mixture under mechanical agitation. After mixing until a stable suspension is obtained, the second solution and 3 grams of sodium sulfate salt are added to emulsify the mixture. This second solution contains 100 grams of distilled water and 12 grams of partially methylated methylol melamine resin. This mixture is heated to 70° C. and kept at such temperature for at least 4 or 8 eight hours with continuous stirring to complete encapsulation. 10 grams of acetoacetamide (Sigma-Aldrich, Saint Louis, Mo., U.S.A.) are added to the suspension. An average capsule size of 60 um is obtained as analyzed by the method described above.

Example 5

35 grams of butyl acrylate-acrylic acid copolymer and acrylic acid emulsifier (Colloid C351, 25% solids, pka 4.5-4.7, Kemira Chemicals, Inc. Kennesaw, Ga. U.S.A.) are dissolved and mixed in 200 grams deionized water. The pH of the solution is adjusted to pH of from 5 to 6 with sodium hydroxide solution. 8 grams of partially methylated methylol melamine resin (Cymel 385, 80% solids, Cytec Industries West Paterson, N.J., U.S.A.) are added to the emulsifier solution. 200 grams of a suspension formed by a solid, water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands (with 99% of the particles having a particle size of 3.65 microns), a polysiloxane (Dow Corning 200® 60,000 centistokes, Dow Corning) and a hydrophobic organic composition formulated with materials listed in Tables 1 to 10, is added to the previous mixture under mechanical agitation. After mixing until a stable emulsion is obtained, the second solution and 7 grams of sodium sulfate salt are added to the emulsion. This second solution contains 4 grams of poly-acrylic acid emulsifier, 120 grams of distilled water, 12 grams of partially methylated methylol melamine resin. This mixture is heated to 70° C. and kept at such temperature for at 6 hours with continuous stifling to complete encapsulation. 18 grams of acetoacetamide (Sigma-Aldrich, Saint Louis, Mo., U.S.A.) are added to the suspension. An average capsule size of 40 microns is obtained as analyzed by the method described above.

Example 6

Production of Spray Dried Microcapsule 1200 g of microcapsule slurry made in example 1, containing one or more of the variants of microcapsules disclosed in the present specification, is mixed together with 700 g of water for 10 minutes using an IKA Eurostar mixer with R1382 attachment at a speed of 180 rpm. The mixture is then transferred over to a feeding vessel to be spray dried in a 1.2 m diameter Niro Production Minor. The slurry is fed into the tower using a Watson-Marlow 504 U peristaltic pump and atomised using a 100 mm diameter rotary atomiser run at 18000 rpm, with co-current air flow for drying. The slurry is dried using an inlet temperature of 200° C. and outlet temperature of 95° C. to form a fine powder. The equipment used the spray drying process may be obtained from the following suppliers: IKA Werke GmbH & Co. KG, Janke and Kunkel—Str. 10, D79219 Staufen, Germany; Niro A/S Gladsaxevej 305, P.O. Box 45, 2860 Soeborg, Denmark and Watson-Marlow Bredel Pumps Limited, Falmouth, Cornwall, TR11 4RU, England.

Example 7

Liquid Laundry Formulations (HDLs)

Non-limiting examples of product formulations containing an encapsulated solid water soluble benefit agent summarized in the following table

| Ingredient | HDL 1 | HDL 2 | HDL 3 | HDL 4 | HDL 5 | HDL 6 |
|---|---|---|---|---|---|---|
| Alkyl Ether Sulphate | 0.00 | 0.50 | 12.0 | 12.0 | 6.0 | 7.0 |
| Dodecyl Benzene Sulphonic Acid | 8.0 | 8.0 | 1.0 | 1.0 | 2.0 | 3.0 |
| Ethoxylated Alcohol | 8.0 | 6.0 | 5.0 | 7.0 | 5.0 | 3.0 |
| Citric Acid | 5.0 | 3.0 | 3.0 | 5.0 | 2.0 | 3.0 |
| Fatty Acid | 3.0 | 5.0 | 5.0 | 3.0 | 6.0 | 5.0 |
| Ethoxysulfated hexamethylene diamine quaternized | 1.9 | 1.2 | 1.5 | 2.0 | 1.0 | 1.0 |
| Diethylene triamine penta methylene phosphonic acid | 0.3 | 0.2 | 0.2 | 0.3 | 0.1 | 0.2 |
| Enzymes | 0.8 | 0.0 | 0 | 0.0 | 1.2 | 0.0 |
| Brightener (disulphonated diamino stilbene based FWA) | 0.14 | 0.09 | 0 | 0.14 | 0.01 | 0.09 |
| Cationic hydroxyethyl cellulose | 0 | 0 | 0.10 | 0 | 0.200 | 0.30 |
| Poly(acrylamide-co-diallyldimethylammonium chloride) | 0 | 0 | 0 | 0.50 | 0.10 | 0 |
| Thickener | 0.50 | 0.44 | 0.2 | 0.2 | 0.3 | 0.3 |
| Boric acid | 2.4 | 0.0 | 0.0 | 0.0 | 1.0 | 0.0 |
| Ethanol | 0.0 | 1.0 | 0.0 | 0.5 | 1.0 | 1.0 |
| 1,2 propanediol | 2.5 | 3.0 | 3.0 | 2.5 | 0.01 | 0.01 |
| Glutaraldehyde | 0 | 0 | 19 ppm | 0 | 13 ppm | 0 |
| Diethyleneglycol (DEG) | 1.6 | 0 | 0 | 0 | 0 | 0 |
| 2,3-Methyl-1,3-propanediol (M pdiol) | 1.0 | 1.0 | 0 | 0 | 0 | 0 |
| Mono Ethanol Amine | 1.0 | 0.5 | 0 | 0 | 0 | 0 |
| NaOH Sufficient To Provide Formulation pH of: | pH 8 | pH 8 | pH 8 | pH 8 | pH 8 | pH 8 |
| Sodium Cumene Sulphonate (NaCS) | 2.00 | 0 | 0 | 0 | 0 | 0 |
| Silicone (PDMS) emulsion | 0.003 | 0.003 | 0.003 | 0.003 | 0.003 | 0.003 |
| Amine* | 0.0 | 0.10 | 0.0 | 0.0 | 0.0 | 0.0 |
| Perfume composition | 0.0 | 0.0 | 0.4 | 0.0 | 0.0 | 0.0 |
| Encapsulated solid water soluble benefit agent[a] | 1.7 | 3.4 | 2.5 | 1.3 | 0.9 | 1.2 |
| Water | Balance | Balance | Balance | Balance | Balance | Balance |

*One or more materials comprising an amine moiety as disclosed in the present specification.

[a]slurry of encapsulated water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands

Example 8

Dry Laundry Formulations

Non-limiting examples of dry laundry product formulations containing particles of the aforementioned examples are summarized in the following table.

| | % w/w granular laundry detergent composition | | | | | | |
|---|---|---|---|---|---|---|---|
| Component | A | B | C | D | E | F | G |
| Brightener | 0.1 | 0.1 | 0.1 | 0.2 | 0.1 | 0.2 | 0.1 |
| Soap | 0.6 | 0.6 | 0.6 | 0.6 | 0.6 | 0.6 | 0.6 |
| Ethylenediamine disuccinic acid | 0.1 | 0.1 | 0.1 | 0.1 | 0.1 | 0.1 | 0.1 |
| Acrylate/maleate copolymer | 1.5 | 1.5 | 1.5 | 1.5 | 1.5 | 1.5 | 1.5 |
| Hydroxyethane di(methylene phosphonic acid) | 0.4 | 0.4 | 0.4 | 0.4 | 0.4 | 0.4 | 0.4 |
| Mono-$C_{12}$-$C_{14}$ alkyl, di-methyl, mono-hydroyethyl quaternary ammonium chloride | 0.5 | 0.5 | 0.5 | 0.5 | 0.5 | 0.5 | 0.5 |
| Linear alkyl benzene | 0.1 | 0.1 | 0.2 | 0.1 | 0.1 | 0.2 | 0.1 |
| Linear alkyl benzene sulphonate | 10.3 | 11.1 | 19.9 | 14.7 | 10.3 | 17 | 10.5 |
| Magnesium sulphate | 0.4 | 0.4 | 0.4 | 0.4 | 0.4 | 0.4 | 0.4 |
| Sodium carbonate | 19.5 | 19.2 | 9.8 | 18.5 | 29.9 | 10.1 | 16.8 |
| Sodium sulphate | 29.6 | 29.8 | 38.8 | 15.1 | 23.9 | 19.5 | 19.1 |
| Sodium Chloride | 0.1 | 0.1 | 0.1 | 0.1 | 0.1 | 0.1 | 0.1 |
| Zeolite | 9.6 | 9.4 | 7.5 | 18 | 10 | 13.2 | 17.3 |
| Photobleach particle | 0.1 | 0.1 | 0.2 | 0.1 | 0.2 | 0.1 | 0.2 |

-continued

| Component | % w/w granular laundry detergent composition | | | | | | |
|---|---|---|---|---|---|---|---|
| | A | B | C | D | E | F | G |
| Blue and red carbonate speckles | 1.8 | 1.8 | 1.8 | 1.8 | 1.8 | 1.8 | 1.8 |
| Ethoxylated Alcohol AE7 | 1 | 1 | 1 | 1 | 1 | 1 | 1 |
| Tetraacetyl ethylene diamine agglomerate (92 wt % active) | 0.9 | 0.9 | 0.9 | 0.9 | 0.9 | 0.9 | 0.9 |
| Citric acid | 1.4 | 1.4 | 1.4 | 1.4 | 1.4 | 1.4 | 1.4 |
| PDMS/clay agglomerates (9.5% wt % active PDMS) | 10.5 | 10.3 | 5 | 15 | 5.1 | 7.3 | 10.2 |
| Polyethylene oxide | 0.2 | 0.2 | 0.2 | 0.2 | 0.2 | 0.2 | 0.2 |
| Enzymes e.g. Protease (84 mg/g active), Amylase (22 mg/g active) | 0.2 | 0.3 | 0.2 | 0.1 | 0.2 | 0.1 | 0.2 |
| Suds suppressor agglomerate (12.4 wt % active) | 0.2 | 0.2 | 0.2 | 0.2 | 0.2 | 0.2 | 0.2 |
| Sodium percarbonate (having from 12% to 15% active AvOx) | 7.2 | 7.1 | 4.9 | 5.4 | 6.9 | 19.3 | 13.1 |
| Perfume oil | 0.5 | 0.5 | 0.5 | 0.5 | 0.5 | 0.5 | 0.5 |
| Solid perfume particles | 0.6 | 0.4 | 0 | 0.4 | 0.4 | 0.4 | 0.5 |
| Particles* | 0.3 | 0.1 | 2.4 | 1.3 | 1.8 | 1.5 | 0.8 |
| Water | 1.4 | 1.4 | 1.4 | 1.4 | 1.4 | 1.4 | 1.4 |
| Misc | 0.9 | 1.0 | 0.0 | 0.1 | 0.1 | 0.1 | 0.1 |
| Total Parts | 100 | 100 | 100 | 100 | 100 | 100 | 100 |

*Particles like the ones made in example 6

Example 9

Liquid Unit Dose

The following are examples of unit dose executions wherein the liquid composition is enclosed within a PVA film. The preferred film used in the present examples is Monosol M8630 76 μm thickness.

| | D 3 compartments | | | E 2 compartments | | F 3 compartments | | |
|---|---|---|---|---|---|---|---|---|
| | Compartment # | | | | | | | |
| | 42 | 43 | 44 | 45 | 46 | 47 | 48 | 49 |
| | Dosage (g) | | | | | | | |
| | 34.0 | 3.5 | 3.5 | 30.0 | 5.0 | 25.0 | 1.5 | 4.0 |
| Ingredients | Weight % | | | | | | | |
| Alkylbenzene sulfonic acid | 20.0 | 20.0 | 20.0 | 10.0 | 20.0 | 20.0 | 25 | 30 |
| Alkyl sulfate | | | | 2.0 | | | | |
| $C_{12-14}$ alkyl 7-ethoxylate | 17.0 | 17.0 | 17.0 | | 17.0 | 17.0 | 15 | 10 |
| $C_{12-14}$ alkyl ethoxy 3 sulfate | 7.5 | 7.5 | 7.5 | | | 7.5 | 7.5 | |
| Citric acid | 0.5 | | 2.0 | 1.0 | | | | 2.0 |
| Zeolite A | | | | 10.0 | | | | |
| $C_{12-18}$ Fatty acid | 13.0 | 13.0 | 13.0 | | 18.0 | 18.0 | 10 | 15 |
| Sodium citrate | | | | 4.0 | 2.5 | | | |
| enzymes | 0-3 | 0-3 | 0-3 | 0-3 | | 0-3 | 0-3 | 0-3 |
| Sodium Percarbonate | | | | 11.0 | | | | |
| TAED | | | | 4.0 | | | | |
| Polycarboxylate | | | | 1.0 | | | | |
| Ethoxylated Polyethylenimine[1] | 2.2 | 2.2 | 2.2 | | | | | |
| Hydroxyethane diphosphonic acid | 0.6 | 0.6 | 0.6 | 0.5 | | | 2.2 | |
| Ethylene diamine tetra(methylene phosphonic) acid | | | | | | 0.4 | | |
| Brightener | 0.2 | 0.2 | 0.2 | 0.3 | | 0.3 | | |
| Particles[2] | 1.0 | 0.1 | 0.1 | 1.2 | 0 | 0 | 0.4 | 0.4 |
| Water | 9 | 8.5 | 10 | 5 | 11 | 10 | 10 | 9 |
| CaCl2 | | | | | | | 0.01 | |
| Perfume | 1.7 | 1.7 | | 0.6 | | 1.5 | 0.5 | |

-continued

| | D 3 compartments | | | E 2 compartments | | F 3 compartments | | |
|---|---|---|---|---|---|---|---|---|
| | Compartment # | | | | | | | |
| | 42 | 43 | 44 | 45 | 46 | 47 | 48 | 49 |
| | Dosage (g) | | | | | | | |
| | 34.0 | 3.5 | 3.5 | 30.0 | 5.0 | 25.0 | 1.5 | 4.0 |
| Ingredients | Weight % | | | | | | | |
| Minors (antioxidant, sulfite, aesthetics, . . .) | 2.0 | 2.0 | 2.0 | 4.0 | 1.5 | 2.2 | 2.2 | 2.0 |
| Buffers (sodium carbonate, monoethanolamine)[3] | To pH 8.0 for liquids To RA >5.0 for powders | | | | | | | |
| Solvents (1,2 propanediol, ethanol), Sulfate | To 100 p | | | | | | | |

[1]Polyethylenimine (MW = 600) with 20 ethoxylate groups per —NH.

[3]RA = Reserve Alkalinity (g NaOH/dose)

[2]Particles added as 0.1-5% active slurry of encapsulated water soluble manganese complex, such as of meso-5,5,7,12,12,14-hexamethyl-1,4,8,11-tetraazacyclotetradecane and racemic-5,5,7,12,12,14-hexamethyl-1,4,8,11-tetraazacyclotetradecane ligands The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising:

a) particles, said particles comprising a shell material and a core material, said shell material encapsulating said core material, said shell material comprising a material selected from cross-linked melamine formaldehyde, cross-linked urea formaldehyde and mixtures thereof; said core material comprising a protective suspension agent, wherein said protective suspension agent comprises an organosilicone, wherein said organosilicone has a viscosity at 25° C. of from 12,500 centistokes to about 2,000,000 centistokes; said core material further comprising a solid water soluble benefit agent, wherein said solid water soluble benefit agent comprises a material selected from the group consisting of a metal catalyst, a non-metal catalyst, an activator, a pre-formed peroxy carboxylic acid, a diacyl peroxide, a hydrogen peroxide source, an enzyme, and mixtures thereof; and said core material further comprising hydrophobic organic material; wherein at least 75% of said particles having a fracture strength of from about 0.1 MPa to about 5 MPa; and b) a consumer product adjunct ingredient.

2. A consumer product according to claim 1, wherein said core material comprises, based total core weight, from about 0.01% to about 80% solid water soluble benefit agent.

3. A consumer product according to claim 1, wherein said core material comprises, based total core weight, from about 0.1% to about 99% of said protective suspension agent.

4. A consumer product according to claim 1, wherein said core material comprises, based total core weight, from about 0.1% to about 99% of said hydrophobic organic material.

5. A consumer product according to claim 1, wherein said particle comprises, based total particle weight, from about 1% to about 95% of said core material.

6. A consumer product according to claim 1, wherein said consumer product comprises, based total consumer product weight, from about 0.01% to about 80% of said particle.

7. A consumer product according to claim 1, wherein:

a) said metal catalyst comprises a material selected from the group consisting of dichloro-1,4-diethyl-1,4,8,11-tetraaazabicyclo[6.6.2]hexadecane manganese(II); dichloro-1,4-dimethyl-1,4,8,11-tetraaazabicyclo[6.6.2]hexadecane manganese(II) and mixtures thereof;

b) said non-metal catalyst comprises a material selected from the group consisting of 2-[3-[(2-hexyldodecyl)oxy]-2-(sulfooxy)propyl]-3,4-dihydroisoquinolinium, inner salt; 3,4-dihydro-2-[3-[(2-pentylundecyl)oxy]-2-(sulfooxy)propyl]isoquinolinium, inner salt; 2-[3-[(2-butyldecyl)oxy]-2-(sulfooxy)propyl]-3,4-dihydroisoquinolinium, inner salt; 3,4-dihydro-2-[3-(octadecyloxy)-2-(sulfooxy)propyl]isoquinolinium, inner salt; 2-[3-(hexadecyloxy)-2-(sulfooxy)propyl]-3,4-dihydroisoquinolinium, inner salt; 3,4-dihydro-2-[2-(sulfooxy)-3-(tetradecyloxy)propyl]isoquinolinium, inner salt; 2-[3-(dodecyloxy)-2-(sulfooxy)propyl]-3,4-dihydroisoquinolinium, inner salt; 2-[3-[(3-hexyldecyl)oxy]-2-(sulfooxy)propyl]-3,4-dihydroisoquinolinium, inner salt; 3,4-dihydro-2-[3-[(2-pentylnonyl)oxy]-2-(sulfooxy)propyl]isoquinolinium, inner salt; 3,4-dihydro-2-[3-[(2-propylheptyl)oxy]-2-(sulfooxy)propyl]isoquinolinium, inner salt; 2-[3-[(2-butyloctyl)oxy]-2-(sulfooxy)propyl]-3,4-dihydroisoquinolinium, inner salt; 2-[3-(decyloxy)-2-(sulfooxy)propyl]-3,4-dihydroisoquinolinium, inner salt; 3,4-dihydro-2-[3-(octyloxy)-2-(sulfooxy)propyl]isoquinolinium, inner salt; 2-[3-[(2-ethylhexyl)oxy]-2-(sulfooxy)propyl]-3,4-dihydroisoquinolinium, inner salt and mixtures thereof;

c) said activator comprises a material selected from the group consisting of tetraacetyl ethylene diamine (TAED); benzoylcaprolactam (BzCL); 4-nitrobenzoylcaprolactam; 3-chlorobenzoy¬ caprolactam; benzoyloxybenzenesulphonate (BOBS); nonanoyloxybenzene¬ isulphonate (NOBS); phenyl benzoate (PhBz); decanoyloxybenzenesulphonate ($C_{10}$—OBS); benzoylvalerolactam (BZVL); octanoyloxybenzenesulphonate ($C_8$—OBS); perhydrolyzable esters; 4-[N-(nonaoyl)amino hexanoyloxy]-benzene sulfonate sodium salt (NACA—OBS); dodecanoyloxybenzenesulphonate (LOBS or $C_{12}$—OBS); 10-undecenoyloxybenzenesulfonate (UDOBS or $C_{11}$—OBS with unsaturation in the 10 position); decanoyloxybenzoic acid (DOBA); (6-octanamidocaproyl)oxybenzenesulfonate; (6-nonanamidocaproyl) oxybenzenesulfonate; (6-decanamidocaproyl)oxybenzenesulfonate and mixtures thereof;

d) said preformed peracid comprises a material selected from the group consisting of peroxymonosulfuric acids; perimidic acids; percabonic acids; percarboxilic acids and salts of said acids, and mixtures thereof;

e) said diacyl peroxide comprises a material selected from the group consisting of dinonanoyl peroxide, didecanoyl peroxide, diundecanoyl peroxide, dilauroyl peroxide, dibenzoyl peroxide, di-(3,5,5-trimethyl hexanoyl) peroxide and mixtures thereof;

f) said hydrogen peroxide source comprises a material selected from the group consisting of a perborate, a percarbonate a peroxyhydrate, a peroxide, a persulfate and mixtures thereof; and g) said enzyme comprises a material selected from the group consisting of peroxidases, proteases, lipases, phospholipases, cellobiohydrolases, cellobiose dehydrogenases, esterases, cutinases, pectinases, mannanases, pectate lyases, keratinases, reductases, oxidases, phenoloxidases, lipoxygenases, ligninases, pullulanases, tannases, pentosanases, glucanases, arabinosidases, hyaluronidase, chondroitinase, laccases, amylases, and mixtures thereof.

8. A consumer product according to claim 1, wherein said organosilicone is linear, branched and/or crosslinked.

9. A consumer product according to claim 8, wherein said organosilicone comprises a material selected from the group consisting of non-functionalized siloxane polymers, functionalized siloxane polymers and mixtures thereof.

10. A consumer product according to claim 9, wherein said functionalized siloxane polymers comprises an aminosilicone.

11. A consumer product according to claim 1, wherein said hydrophobic organic material comprises a material having a ClogP from about 1.5 to about 10.

12. A consumer product according to claim 1, wherein said hydrophobic organic material comprises a material selected from the group consisting of an aliphatic hydrophobic organic material, an aromatic hydrophobic organic material and mixtures thereof.

13. A consumer product according to claim 1, wherein said hydrophobic organic material comprises a material selected from the group consisting of a carboxylic acid, an ester, an alcohol, a fatty acid, a natural oil, a synthetic oil, an aldehyde, a ketone, a nitrile, a hydrocarbon, an ether, an acetal, a Schiff Base, a wax and mixtures thereof.

14. A consumer product according to claim 13, wherein;

a) said alcohol comprises a material selected from the group consisting of lauryl alcohol, citronellol, alpha-terpineol, 2-tert-butylcyclohexanol, 2,6-dimethyl-2-octanol, 3,7-dimethyl-3-octanol and 2,6-dimethyl-2-octanol, 2-methyl-4-(2,2,3-trimethyl-3-cyclopentenyl)-2-buten-1-ol, linalool, tetrahydrolinalool and mixtures thereof;

b) said ester comprises a material selected from the group consisting of methyl laurate, methyl jasmonate, hexyl isovalerate, geranyl acetate, 1,4-dioxacyclohexadecane-5,16-dione, 4-tert-butylcyclohexyl acetate, 3,5,5-trimethylhexyl acetate, ethyl-2-methylpentanoate, ethyl methyl-2-butyrate, isopropyl myristate and mixtures thereof;

c) said ether comprises a material selected from the group consisting of (3z)-1-[(2-methyl-2-propenyl)oxy]-3-hexene, decahydrospiro[furan-2(3 h), 5'-[4.7] methano[5 h[indene], 4,9,12,12-tetramethyl-5-oxatricyclo[8.2.0.0(4,6)]dodecane, decahydro-2,6,6,7,8,8-hexamethyl-2 h-indeno[4,5-b]furan, isomers of decahydro-2,6,6,7,8,8-hexamethyl-2 h-indeno[4,5-b] furan, 2-(1-ethylpentyl)-1,3-dioxolane, 2-methyl-1,5-dioxaspiro[5.5]undecane, phenyl ethyl cyclohexyl ether and mixtures thereof;

d) said carboxylic acid comprises a material selected from the group consisting of lauric acid, myristic acid, 2,4-dimethoxybenzoic acid, 2,4-dimethyl-2-pentenoic acid, geranic acid, salicylic acid, cyclohexylacetic acid and mixtures thereof;

e) said nitrile comprises a material selected from the group consisting of lauryl nitrile, 2-phenyl hexanenitrile, methyl 2-[{(4-(4-hydroxy-4-methylpentyl)-1-cyclohexenyl)methylene}amino}benzoate, 2,2,4-trimethyl-4-phenyl-butanenitrile, 3,7-dimethyloctanenitrile, (e)-3-phenyl-2-propenenitrile, 3,7-dimethyl-6-octenenitrile and mixtures thereof;

f) said amine comprises a material selected from the group consisting of 4-(4,8-dimethyl-3,7-nonadienyl)pyridine, (2-methylpropyl)-quinoline and mixtures thereof;

g) said ketone comprises a material selected from the group consisting of dihydrojasmone, methyl-beta-ionone, methyl heptenone, 6,10-dimethylundecen-2-one, 1,3,4,6,7,8a-hexahydro-1,1,5,5-tetramethyl-2 h-2,4a-methanonaphthalen-8(5 h)-one, 5-cyclohexadecen-1-one, Ionone and mixtures thereof;

h) said aldehyde comprises a material selected from the group consisting of lauric aldehyde, amyl cinnamic aldehyde, 3,6(and 4,6)-dimethylcyclohex-3-ene-1-carboxaldehyde, 2,4-dimethyl-3-cyclohexene-1-carboxaldehyde, 1-methyl-4-(4-methyl-3-pentenyl)cyclohex-3-ene-1-carboxaldehyde, 3-(and 4-)(4-methyl-3-pnetyl) cyclohex-3-ene-1-carboxaldehyde, ((3,7,-dimethyl-6-octenyl)oxy)acetaldehyde and mixtures thereof;

i) said hydrocarbon comprises a material selected from the group consisting of isolongifolene, limonene, terpinolene, 3,7-dimethyl-1,3,6-octatriene, bisabolene alpha-pinene and mixtures thereof;

j) said Schiff base comprises a material selected from the group consisting of methyl anthranilate/citronellal Schiff base, isononylaldehyde/methylanthranilate Schiff base, methyl N-(3,7-dimethyl-7-hydroxyoctylidene)-anthranilate Schiff-base and mixtures thereof;

k) said wax comprises a material selected from the group consisting of carnauba wax, beeswax, paraffin, petrolatum, polytetrafluoroethylene wax, and mixtures thereof;

l) said natural and synthetic oils comprise a material selected from the group consisting of lavender oil, cedarwood oil, vegetable oil, brominated oil, eucalyptol oil, ylang ylang oil, patchouli oil, bergamot oil and mixtures thereof.

15. A consumer product according to claim 1 having a benefit agent release of at least 10% of said benefit agent after 10 minutes of use of such consumer product containing said particles.

16. A consumer product according to claim 1, wherein at least 75% of said particles have a particle size of from about 1 microns to about 100 microns.

17. A consumer product according to claim 1, wherein at least 75% of said particles have a particle wall thickness of from about 30 nm to about 250 nm.

18. A consumer product according to claim 1, said consumer further product comprising a material selected from a group consisting of a formaldehyde scavenger, a structurant, an anti-agglomeration agent and mixtures thereof.

19. A consumer product according to claim 1 comprising, based on the total consumer product weight, less than 85% total water.

20. A method of treating and/or cleaning a situs, said method comprising:

a) optionally washing and/or rinsing said situs;

b) acting said situs with a consumer product according to claim 1; and c) optionally washing and/or rinsing said situs.

* * * * *